United States Patent [19]

Schäfer et al.

[11] 4,113,537

[45] Sep. 12, 1978

[54] HEAT RESISTANT NONWOVEN FABRIC AND METHOD OF MANUFACTURING SAME

[75] Inventors: Werner Schäfer, Birkenau; Holger Buchwald, Hemsbach; Dieter Bischoff, Furth, all of Germany

[73] Assignee: Firma Carl Freudenberg, Weinheim, Germany

[21] Appl. No.: 637,488

[22] Filed: Dec. 3, 1975

[30] Foreign Application Priority Data

Dec. 7, 1974 [DE] Fed. Rep. of Germany ..... 2458037
Dec. 7, 1974 [DE] Fed. Rep. of Germany ..... 2458038

[51] Int. Cl.[2] ..... B32B 27/02

[52] U.S. Cl. ..... 428/220; 428/288; 428/290; 428/296; 428/474

[58] Field of Search ..... 428/195, 288, 289, 290, 428/296, 297, 303, 474, 220; 260/75 R, 78 TF, 78 R

[56] References Cited

U.S. PATENT DOCUMENTS

| | | | |
|---|---|---|---|
| 3,094,511 | 6/1963 | Hill et al. | 260/78 R |
| 3,203,933 | 8/1965 | Huffman et al. | 260/78 R |
| 3,354,127 | 11/1967 | Hill et al. | 260/78 R |
| 4,029,835 | 6/1977 | Iwata et al. | 428/212 |

*Primary Examiner*—James J. Bell
*Attorney, Agent, or Firm*—Burgess, Dinklage & Sprung

[57] ABSTRACT

A high-temperature-resistant nonwoven fabric comprising synthetic fibers bonded to one another, said fibers comprising at least one polyaryl amide, polyaryl imide, polyaryl ester or polyaryl anhydride, said fibers being resistant to temperatures up to about 350° C and being resistant to prolonged exposure to a temperature of at least 200° C, is produced by bonding a suitable nonwoven web employing a solution containing a swelling agent and/or a bonding agent for the fiber. If a bonding agent is present, it is of substantially the same composition as the fiber and is precipitated or coagulated by treating the impregnated web with a liquid miscible with the solvent of the solution but which is a non-solvent for the bonding agent. The fabric is washed and dried and then preferably calendered at high temperature so that all the polymeric material is crystallized.

8 Claims, No Drawings

HEAT RESISTANT NONWOVEN FABRIC AND METHOD OF MANUFACTURING SAME

BACKGROUND

The invention relates to a heat-resistant nonwoven fabric made of bonded synthetic staple and/or endless fibers and to a method of manufacturing same. The nonwoven fabric is characterized by an especially good continuous heat resistance such as is desired in numerous applications, as for example in electrical insulation.

It is known to use nonwoven fabrics in the electrical insulation art, for example as supporting materials for insulating resins. Nonwovens consisting of 100% polyester fibers are commonly used for this purpose, being made into pre-impregnated products known as "prepregs" for later fabrication. That is, they are impregnated with a reactive insulating resin, usually on the basis of epoxides and polyimides, and the resin is transformed by a heat treatment to the "B-stage" in which the resin is not yet fully hardened. The final hardening is performed after the fabricated part has been installed, in a transformer or an electric motor, for example. In some cases, however, the nonwoven fabric is fabricated without preimpregnation, and then one of the above-mentioned resins is applied to it to produce the insulating properties. Such nonwoven fabrics combined with insulating resins can be used with great reliability as insulation material as long as the temperatures to which they are continuously exposed in operation do not exceed 165° C.

Increasingly stringent requirements in the electrical insulating art necessitate a search for insulating materials of greater stability, especially materials of improved resistance of continuous exposure to heat. There is an increasing demand for insulating materials which can resist continuous exposure to temperatures up to 250° C. Indeed, the short-term ability of such materials to withstand heat must be even higher, and should be of the order of about 350° C. For example, extremely fine glass fabrics and papers on the basis of polyaryl amides can be used within the above-stated temperature range. Such products, however, usually do not provide the desired uniformity of structure, and in addition they are often too coarse, since not only the ability to withstand heat is required, but also great fineness of the fibers—less than 200$\mu$, and preferably from about 30 to 80$\mu$. To assure optimum insulation even at high voltages, the insulating resin must be absorbed very uniformly by the nonwoven fabric serving as the support; this is not the case with the materials known hitherto. The invention is therefore addressed to the problem of developing a heat-resistant and at the same time fine, bonded nonwoven fabric of very uniform porosity.

THE INVENTION

A heat-resistant nonwoven fabric of bonded synthetic staple and/or endless fibers is proposed in accordance with the invention, which is characterized in that the staple and/or endless fibers consist of a polyaryl amide, polyaryl imide, polyaryl ester and/or polyaryl anhyride which is heat-resistant up to about 350° C. and can withstand continuous exposure to temperatures of at least 200° to 250° C., the fibers being bonded to one another without foreign bonding agents. The bonds can be simple fusion bonds or they can be formed by depositing onto the fibers from solution a bonding agent which is chemically similar to the fibers so that the total final structure is of a single chemical kind and will have the same chemical and thermal resistance.

The fibers, whether softened by a solvent or coated with a bonding agent deposited from a solvent, are generally washed to remove adherent solvent and then calendered to ensure crystallization and hence physical enhancement of the material making up the bond.

Representative fiber-forming materials include polymers of aromatic diamines and dicarboxylic acids including, for example, m-phenylenediamine, isophthalic acid, terephthalic acid, and the like, e.g. poly-m-phenylene isophthalamide, polybenzimidazole, and the like. A particularly suitable material is poly-m-phenylene isophthalamide which is resistant to brief exposure to temperatures up to about 350° C. At the same time, it is resistant to continuous exposure to heat within the range of about 200° to 250° C. Those polyaryl amides are especially desirable whose molecular weight is between about 20,000 and 70,000. The bonding agent has substantially the same composition. The fibers and the bonding agents are thus excellently adapted, as regards their characteristics, both to one another and to the requirements which must be met.

The manufacture of the nonwoven fabrics of the invention is performed first by laying down a web of the heatresistant fibers in a known manner by wet or dry methods. The fibers may be continuous as from a tow or may be deposited directly as spun. Alternatively they may be staple fibers as short as 15 mm in length, preferably about 25 to 100 mm in length, preferably crimped to the extent of about 150 to 1000 crimps per meter, especially more than 400 crimps per meter. The fibers may range in denier from 1 or less up to 50 or more although about 2 to 25 and especially about 3 to 15 is preferred. The web made up of such fibers is then treated with a solution which may be a solution or dispersion of a swelling agent for the fibers or of a bonding agent of a composition matching that of the fibers. If a bonding agent is present, it is then deposited by precipitation or by coagulation and set thermally. It is desirable afterward to calender the nonwoven fabric thus formed. In accordance with another method which is also considered desirable, the solution to effect bonding can be printed onto the loose nonwoven fabric and then set by the application of heat and pressure. The pressure and temperature during the compression are to be adjusted such that the crystalline structure of the fibers and/or bonding agents will be preserved. Both of these parameters can be determined, if desired, by means of simple preliminary tests.

In the depositing of the bonding agent by precipitation or coagulation, the nonwoven fabric impregnated with the bonding agent is led through a water bath or is exposed to the action of a non-solvent which brings about the precipitation or coagulation of the bonding agent. Here again, the optimum temperature and the optimum solvent can be determined by means of appropriate preliminary tests. Preferred solvents include dimethylformamide, dimethylacetamide, dimethylsulfoxide and N-methyl-pyrrolidone since these are water-soluble and water can be used to precipitate the bonding agent therefrom.

Nonwoven fabrics of very high strength are obtained by impregnating or imbibing a nonwoven fabric made of polyaryl amide staple fibers with a solution of comparable polyaryl amides. In order to achieve the bonding of the individual fibers, the solvent that is used must be removed as harmlessly as possible. If the solvent is evaporated, damage might be done to polyaryl amide fibers, for example, by the evaporating solvent at elevated temperature, which would limit the use of the nonwoven fabric as insulation material. It has therefore been found desirable to pass the fabric, bonded temporarily as described, into a precipitating bath, such as a water bath, for example. It has been found that the otherwise very sluggishly reacting polyaryl amide fibers are bonded so well by the polyaryl amide precipitating in the water and serving as the bonding agent, that strengths are produced in the fabric which are several times those produced in the nonwoven fabrics of the same weight classes, which have commonly been used hitherto. The polyaryl amide that is precipitated in a system of solvent and water deposits itself on the fibers and produces the bond. After the removal of the water and any residual solvent that may be present, the nonwoven fabric is smoothed between hot calender rolls. During this operation the precipitated amorphous polyaryl amide is converted to the crystalline state. At the same time the calendering process creates the structure that is necessary for an excellent and uniform absorption of resin. Instead of water, it is possible to use for the precipitation other liquids or non-solvents which are mixcible with the solvent that is used, e.g. hydrocarbons, especially alkanes and particularly halogenated lower alkanes such as trichloroethylene.

If bonding is to be achieved without an added bonding agent, the same solvents can be used to treat the non-woven webs except that swelling agents must be added thereto, e.g. salts such as lithium and/or magnesium chloride. Heat may be used to enhance the swelling action which promotes adhesion, e.g. about 80° C. The solvent and salts can thereafter be removed by washing, squeezing and/or vaporation, and especially by calendering. Bonding occurs at the fiber intersections and the resulting fabric is stable and of uniform porosity.

The aforementioned salts may also be present when the solution contains a bonding agent since they promote dissolution of the bonding agent and soften the fiber surfaces to prepare them to accept the bonding agent to be deposited and to enhance fiber-to-fiber bonding in addition to fiber-bonding agent-fiber bonding.

In a preferred embodiment, the nonwoven fabric is uniformly about 20 to 300 microns thick and, at a constant temperature stress within the range of about 200° to 250° C., it still has about 60% of its tensile strength at room temperature.

The invention will be further described in the following illustrative examples wherein all parts are by weight unless otherwise expressed.

EXAMPLES

EXAMPLE 1

A solution is prepared from 87.5 g of dimethyl formamide (DMF), 2.5 g of LiCl and 10 g of poly-m-phenylene isophthalammide having a molecular weight of about 50,000 and stable up to about 350° C. The LiCl serves as a catalyst during the dissolving process; with DMF alone, all that would be accomplished would be a slight swelling of the polyaryl amide. With this solution a nonwoven fabric of poly-m-phenylene isophthalamide fibers weighing 30 g/m$^2$ is impregnated. The size of the fibers is 1.7 dtex. and their cut length is 50 mm. The absorption amounts to 500%, so that, with the use of a 10% solution, a final weight is obtained after drying, of 45 g/m$^2$. The nonwoven fabric thus imbibed is carried into a water bath immediately after the impregnation, whereupon the polyaryl amide precipitates from the solution and deposits itself on the fibers. The DMF together with the LiCl used as the dissolving catalyst passes into the water bath. By using a counterflow process, the DMF solvent and the LiCl can thus be completely washed out of the nonwoven fabric, which is provided with its preliminary bond in this manner. This is very important for its later use as insulation material. As the process continues, the water is squeezed out and the remaining moisture is removed by drying. The result is a relatively bulky, very porous and stiff material, which in many cases can be used in this form. When it is calendered at 200° C., the above-described transformation from the amorphous to the crystalline state takes place, and thus a material of very uniform thickness and porosity is obtained which is suitable for use as insulation material. For a final weight of 45 g/m$^2$, the thickness amounts to approximately 50 to 55 microns.

EXAMPLE 2

Similar to Example 1, the bonding of the nonwoven fiber fabric can be accomplished by printing or spraying the polyaryl amide solution thereon. In this case the viscosity desired can be controlled by means of the concentration of the dissolved polyaryl amide. The further process is the same as in Example 1, and nonwovens of different porosity can be obtained according to whether the solution is sprayed on or printed on.

EXAMPLE 3

The precipitation can be performed in trichlorethylene or other solvents miscible with DMF, instead of water. In all cases it is important to remove the DMF and LiCl from the nonwoven fabric. The structure of the fabrics obtained may differ slightly according to the precipitation medium. If solvents which are not miscible with water are used, such as trichloroethylene for example, the LiCl will be in the DMF-trichloroethylene. If this mixture is passed through water, the DMF and LiCl will dissolve in the water, liberating the trichloroethylene which can be recycled. The water is removed from the water-DMF-LiCl mixture by distillation, and the DMF and LiCl remaining can be recycled to dissolve fresh polyaryl amide.

The precipitation can be achieved provided the concentration of the DMF in the precipitating bath does not exceed 50 to 60%. The concentration of the DMF in the precipitation bath can also be used to control the properties of the finished fabric as regards structure and porosity.

EXAMPLE 4

A nonwoven fabric is prepared as in Example 1 from heat-resistant fibers based on polyaryl amide, polyimide, polyester imide, and the like, and is impregnated, imbibed or imprinted with the solution of a heat-resistant resin, e.g., a polyimide resin, which is dissolved in a suitable solvent, such as N-methyl-pyrrolidone for example. After the removal of the solvent, the resin can be set so as to bond the fabric under the action of heat in conjunction with a calendering process. Heat-resistant nonwoven fabrics suitable for temperatures from 165° to about 300° C. can be produced by this method also.

EXAMPLE 5

A nonwoven web weighing 80 g/m$^2$ is prepared from 6 denier fibers of poly-m-phenylene isophthalamide having a molecular weight of about 50,000 and resistant to temperatures up to about 350° C. This web is passed through dimethylformamide at a temperature of about 80° C., the solution containing approximately 2% by weight of LiCl. The polyaryl amide fibers are softened in this manner. This dimethylformamide solution containing LiCl is then completely removed from the fabric by counterflow washing with water and drying, and the bonding of the fibers is accomplished by calendering at about 200° C. Th nonwoven fabric thus obtained is well suited for use as electrical insulating material and has a thickness of approximately 90 to 100 microns.

It is important that the dimethylformamide and the LiCl be completely removed from the fabric. The structure of the fabrics can differ according to the working conditions, especially the time of action of the dimethylformamide containing LiCl. The dimethylformamide and LiCl can be recovered and recycled.

It will be appreciated that the instant specification and examples are set forth by way of illustration and not limitation, and that various modifications and changes may be made without departing from the spirit and scope of the present invention.

What is claimed is:

1. A high-temperature-resistant nonwoven fabric comprising crystalline synthetic fibers bonded to one another by fusion, said fibers comprising at least one polyaryl amide, polyaryl imide, polyaryl ester or polyaryl anhydride, said fibers being resistant to temperatures up to about 350° C. and the fabric being resistant to prolonged exposure to a temperature of at least 200° C.

2. A nonwoven fabric according to claim 1, wherein the fibers have a molecular weight of about 20,000 to 70,000.

3. A nonwoven fabric according to claim 1, wherein the fabric is of substantially uniform thickness between about 20 and 300 microns.

4. A nonwoven fabric according to claim 3, wherein the fibers comprise a crystalline polyaryl amide having a molecular weight of about 20,000 to 70,000.

5. A high-temperature-resistant nonwoven fabric comprising crystalline synthetic fibers comprising at least one polyaryl amide, polyaryl imide, polyaryl ester or polyaryl anhydride, the fibers being bonded to one another with a binder of substantially the same composition as the fibers, said fibers being resistant to temperatures up to about 350° C. and the fabric being resistant to prolonged exposure to a temperature of at least 200° C.

6. A nonwoven fabric according to claim 5, wherein the fibers have a molecular weight of about 20,000 to 70,000.

7. A nonwoven fabric according to claim 5, wherein the fabric is of substantially uniform thickness between about 20 and 300 microns.

8. A nonwoven fabric according to claim 7, wherein the fibers and binder comprise a polyaryl amide having a molecular weight of about 20,000 to 70,000.

* * * * *